US008013279B2

(12) United States Patent
Byun

(10) Patent No.: US 8,013,279 B2
(45) Date of Patent: Sep. 6, 2011

(54) OUTER CASE FOR COOKING APPLIANCE

(75) Inventor: Jun-Bo Byun, Changwon (KR)

(73) Assignee: LG Electronics Inc., Seoul (KR)

( * ) Notice: Subject to any disclaimer, the term of this patent is extended or adjusted under 35 U.S.C. 154(b) by 284 days.

(21) Appl. No.: 11/922,487

(22) PCT Filed: Jun. 20, 2006

(86) PCT No.: PCT/KR2006/002368

§ 371 (c)(1),
(2), (4) Date: Dec. 19, 2007

(87) PCT Pub. No.: WO2006/137675

PCT Pub. Date: Dec. 28, 2006

(65) Prior Publication Data

US 2009/0236336 A1 Sep. 24, 2009

(30) Foreign Application Priority Data

Jun. 20, 2005 (KR) ..... 10-2005-0053138

(51) Int. Cl.
*H05B 6/80* (2006.01)
*H05B 6/64* (2006.01)

(52) U.S. Cl. ..... 219/725; 219/756

(58) Field of Classification Search ..... 219/734, 219/756, 757, 725, 754, 681, 758, 736
See application file for complete search history.

(56) References Cited

U.S. PATENT DOCUMENTS

| | | | | |
|---|---|---|---|---|
| 4,163,141 | A * | 7/1979 | Tanaka et al. | 219/754 |
| 4,484,063 | A | 11/1984 | Whittenburg et al. | |
| 4,858,590 | A | 8/1989 | Bailey | |
| 5,756,974 | A * | 5/1998 | Hong | 219/681 |
| 2003/0106893 | A1 * | 6/2003 | Roh | 219/756 |
| 2004/0134907 | A1 * | 7/2004 | Jeong | 219/756 |

FOREIGN PATENT DOCUMENTS

| | | | |
|---|---|---|---|
| JP | 60245930 A | * | 12/1985 |
| KR | 20-1997-0030777 | * | 10/1997 |
| KR | 2001010252 | * | 7/1999 |
| KR | 20-2000-0005918 | | 4/2000 |
| KR | 20-2000-0035980 | * | 12/2000 |
| KR | 10-2003-0074008 | | 9/2003 |
| KR | 2005012498 | * | 2/2005 |

* cited by examiner

*Primary Examiner* — Quang T Van
*Assistant Examiner* — Hung Nguyen
(74) *Attorney, Agent, or Firm* — KED & Associates, LLP

(57) ABSTRACT

An outer case for a cooking appliance is provided. An opening is formed in an external face plate of the outer case at a position corresponding to selected components of the cooking appliance. The opening is selectively covered with a cover plate so that the components may be selectively accessed through the opening, without removing the outer case. The cover plate may include extensions that are engaged in concave portions of the external face plate, with an opposite end of the cover plate being fastened to the external face plate by fasteners. The external face plate may also include a reinforcement bead and tool passing holes that allow a tool to pass therethrough without removing the external face plate.

9 Claims, 4 Drawing Sheets

【Figure 1】
Prior Art
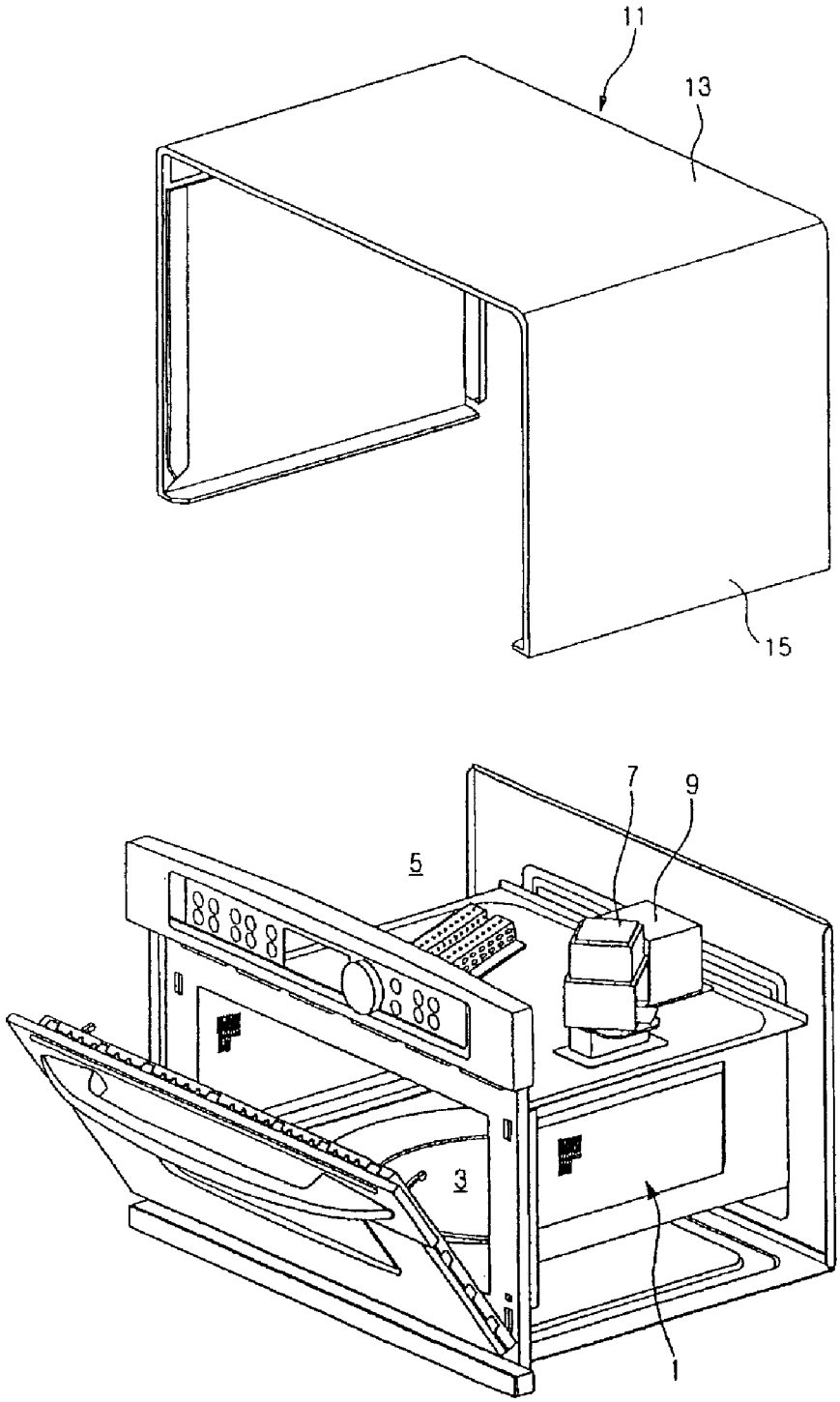

【Figure 2】
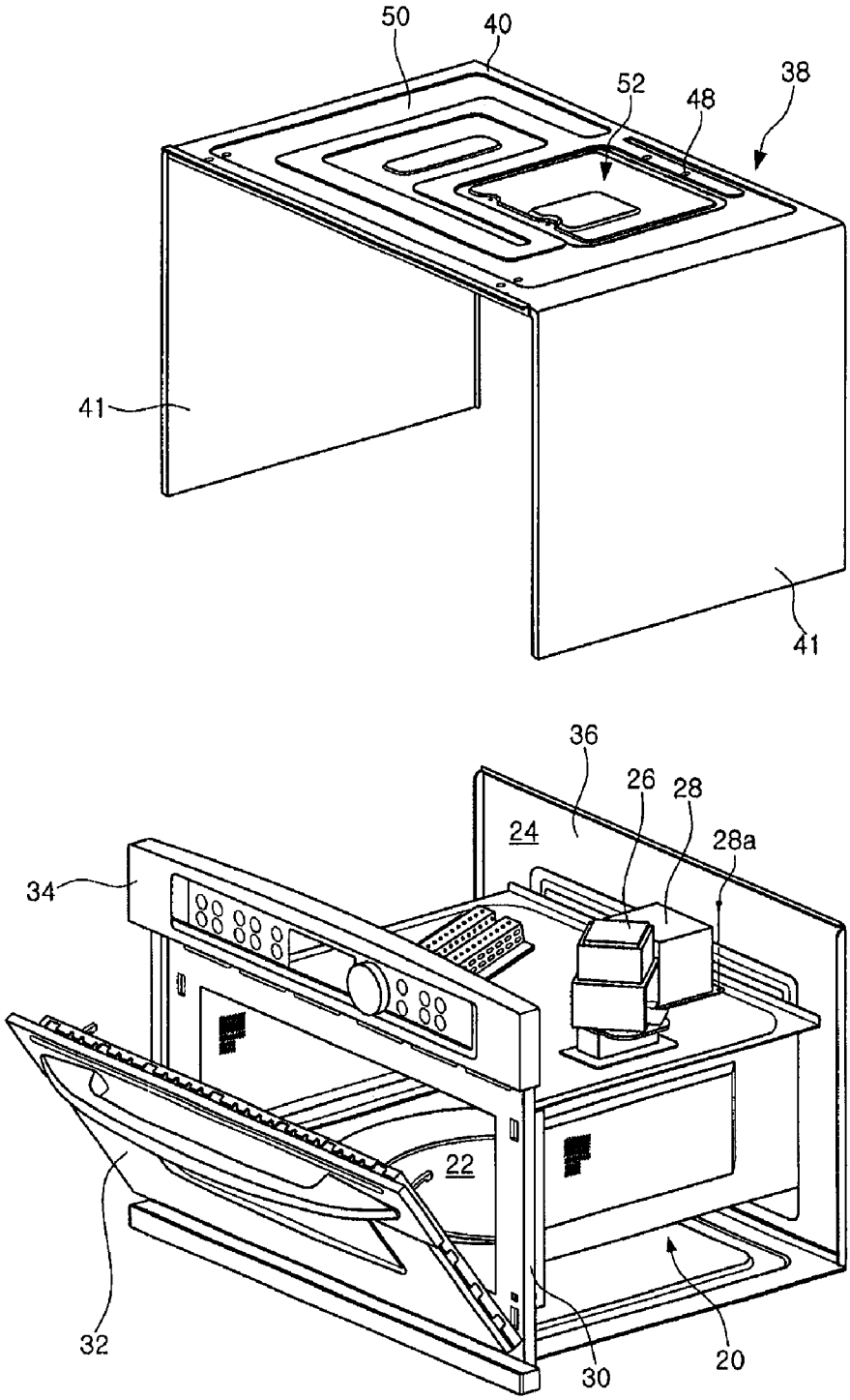

【Figure 3】
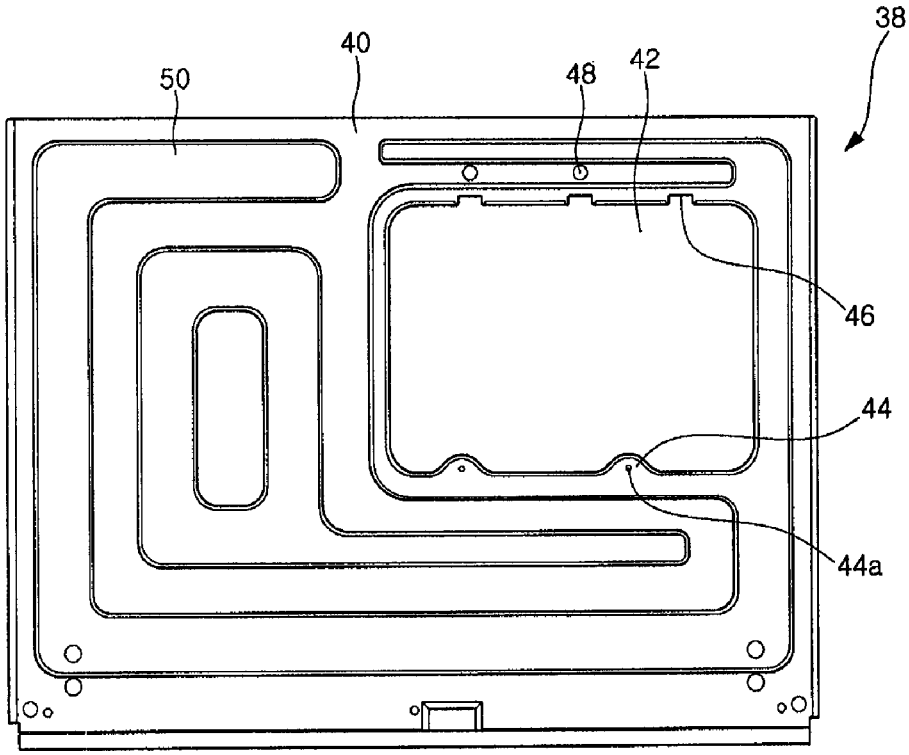

【Figure 4】
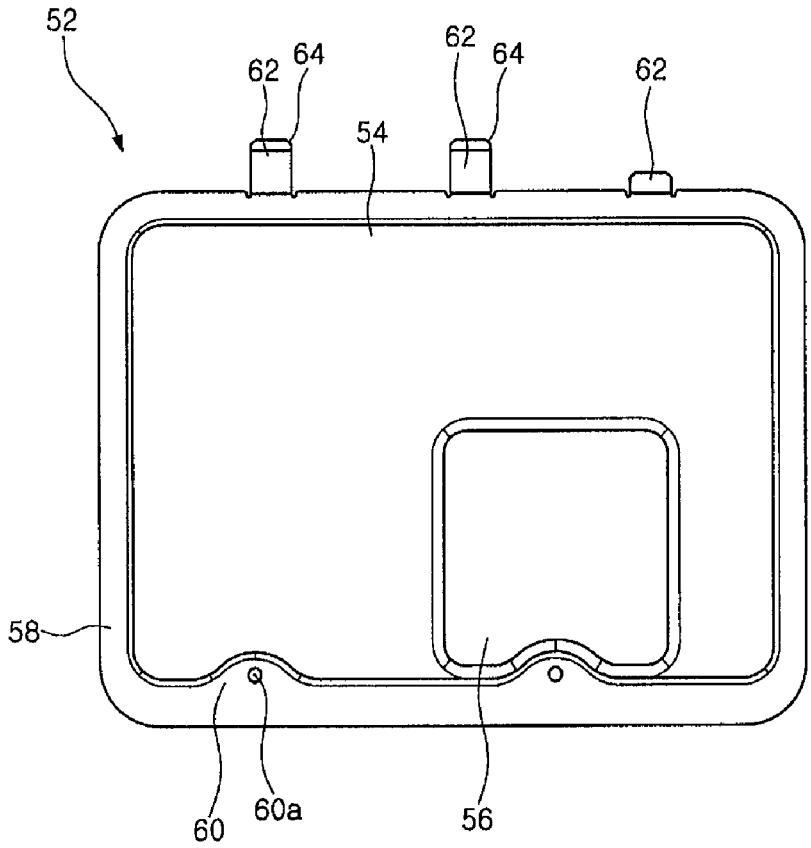

OUTER CASE FOR COOKING APPLIANCE

TECHNICAL FIELD

The present invention relates to a cooking appliance, and more particularly, to an outer case for a cooking appliance, which defines an external appearance of the cooking appliance and covers parts provided therein.

BACKGROUND ART

A cooking appliance is to prepare food by heating an object to be cooked. A microwave oven will be described herein by way of example of a cooking appliance. FIG. 1 is an exploded perspective view showing a conventional microwave oven. Referring to the figure, a cavity assembly 1 forms a frame of a microwave oven. A cooking chamber 3 is defined in the cavity assembly 1. The cooking chamber 3 is a space in which an object to be cooked is accommodated and cooked. An electric equipment installation chamber 5 is defined in an outside of the cavity assembly 1. The electric equipment installation chamber 5 is a space in which parts for heating an object to be cooked in the cooking chamber 3 are installed.

The electric equipment installation chamber 5 is provided over an upper surface of the cavity assembly 1 and contains, for example, a magnetron 7, a high voltage transformer 9, and the like. The magnetron 7 generates microwave for heating an object to be cooked, and the high voltage transformer 9 provides high voltage necessary for generating microwave in the magnetron 7.

An outer case 11 is mounted on the cavity assembly 1 to partially define an external appearance of a microwave oven, and serves to cover the cavity assembly 1 and the parts. The outer case 11 comprises an upper plate portion 13 defining an external appearance of an upper surface of the microwave oven, and side plate portions 15 vertically bent from both ends of the upper plate portion 13 and defining an external appearance of side surfaces of the microwave oven.

However, the aforementioned prior art has the following problems.

During use of a microwave oven, there may be cases where a part installed in the electric equipment installation chamber 5 is out of order. In such a case, it is possible to repair or replace the part in the electric equipment installation chamber 5 in a prior art only after the outer case 11 is separated from the cavity assembly 1. However, there is inconvenience in that a large number of screws should be loosened in order to separate the outer case 11.

Particularly, when a microwave oven is large, it is difficult for a worker to handle the microwave oven by oneself. Further, when a microwave oven is installed at a particular location, there is a problem in that it is impossible for a worker to perform maintenance work by oneself since the microwave oven should be separated from the installation location.

In addition, if an outer case is wholly removed and the interior of a microwave oven is exposed when a microwave oven is repaired, a consumer may consider that the microwave oven might be severely out of order. That is, there is a problem in that a consumer may psychologically distrust the quality of a microwave oven.

DISCLOSURE

Technical Problem

Accordingly, the present invention is conceived to solve the aforementioned problems in the prior art. An object of the present invention is to make it possible to easily maintain and repair parts installed in a cooking appliance.

Another object of the present invention is to minimize a size of an opening formed in an outer case for maintaining and repairing parts installed in a cooking appliance.

A further object of the present invention is to maintain the strength of an outer case although an opening is formed in a portion of the outer case defining an external appearance of a cooking appliance.

Technical Solution

According to an aspect of the present invention for achieving the objects, there is provided an outer case for a cooking appliance, comprising a first external face plate that is formed with an opening at a position corresponding to a part installed in the cooking appliance and defines a portion of an external appearance of the cooking appliance; a cover plate detachably fastened to the first external face plate to cover the opening of the first external face plate; and a bead formed in a concavo-convex shape in an area of the first external face plate except the opening.

A side of an edge of the cover plate may be fastened with a screw to the first external face plate at a corresponding side of an edge of the opening, and the other side of the edge of the cover plate may be caught in and fastened to the first external face plate at a corresponding side of the edge of the opening.

An extension portion may be formed to protrude from the side of the edge of the cover plate, and a concave portion may be formed in the first external face plate at the corresponding side of the edge of the opening, whereby the extension portion is inserted into and caught in the concave portion.

The cover plate may be formed with a reinforcement portion in a concavo-convex shape for increasing strength, a marginal portion may be stepwise formed around the edge of the cover plate, and the marginal portion may be formed with a semicircular portion in a concavo-convex shape.

The semicircular portion may be asymmetrically formed along a side of the marginal portion of the cover plate, the opening of the first external face plate may be formed with a fastening portion at a position corresponding to the semicircular portion, and fastening holes may be respectively formed through the semicircular portion and the fastening portion.

The opening may have an area smaller than a half of an entire area of the first external face plate.

Second external face plates may be perpendicularly provided at both ends of the first external face plate.

Meanwhile, the present invention provides an outer case for a cooking appliance, comprising a first external face plate that is formed with an opening at a position corresponding to a part installed in the cooking appliance and defines a portion of an external appearance of the cooking appliance; and a cover plate detachably fastened to the first external face plate to cover the opening of the first external face plate, wherein a tool-passing hole is formed through the first external face plate in the vicinity of the opening, the tool-passing hole allowing a tool for tightening and loosening a fastener for use in fastening the part to be inserted therethrough.

The cover plate may comprise a body portion shaped corresponding to the opening, a marginal portion stepwise formed around an edge of the body portion to be seated on an edge of the opening, and an extension portion formed to extend from a side of the body portion to cover the tool-passing hole.

The cover plate may be fastened with a fastener to a side of the edge of the opening of the first external face plate. At this time, the fastener may penetrate a semicircular portion asymmetrically formed in a concavo-convex shape along a side of the marginal portion. The extension portion may be inserted into a concave portion formed in the first external face plate.

Second external face plates may be perpendicularly provided at both ends of the first external face plate.

The opening may have an area smaller than a half of an entire area of the first external face plate, and a bead may be formed in a portion of the first external face plate except the opening.

The body portion of the cover plate may be further formed with a reinforcement portion.

The cooking appliance may comprise a microwave oven, and the first external face plate may cover an electric equipment installation chamber defined over a cavity assembly.

Advantageous Effects

According to the present invention thus configured, it is possible to maintain and repair inner parts of the cooking appliance without separating the outer case. Thus, workability of the maintenance is improved, and a consumer is not given a feeling of uneasiness to the performance of the product. There is also an advantage in that by making the size of an opening formed in an outer case relatively small and forming a bead on the outer case, it is possible to maximize the strength of the outer case and thus to increase durability of the cooking appliance.

DESCRIPTION OF DRAWINGS

FIG. 1 is an exploded perspective view showing a conventional microwave oven.

FIG. 2 is an exploded perspective view showing a microwave oven in which a preferred embodiment of an outer case according to the present invention is employed.

FIG. 3 is a plan view showing a major portion of the embodiment according to the present invention.

FIG. 4 is a plan view showing the structure of a cover plate in the embodiment according to the present invention.

BEST MODE

Hereinafter, a preferred embodiment of an outer case according to the present invention will be described in detail with reference to the accompanying drawings.

As shown in FIGS. 2 to 4, a cavity assembly 20 forms a frame of a microwave oven. A cooking chamber 22 for heating an object to be cooked is defined in the cavity assembly 20. The cooking chamber 22 has an open face and allows an object to be cooked to be put in and out through the open face.

An electric equipment installation chamber 24 is provided over the cavity assembly 20. The electric equipment installation chamber 24 is a space in which parts are installed including a magnetron 26, a high voltage transformer 28, a capacitor (not shown), an air duct (not shown) and the like. When the cavity assembly 20 is viewed in a plan view, at a right edge portion of the electric equipment installation chamber 24, i.e., at a position corresponding to an opening 42 of an outer case 38 that will be described below, there are major parts such as the magnetron 26, the high voltage transformer 28 and the like. There are a variety of methods for fixing the magnetron 26, the high voltage transformer 28 and the like to the electric equipment installation chamber 24. For example, the high voltage transformer 28 is fastened with screws 28*a* to an additional base plate of the electric equipment installation chamber (to which reference numeral is not assigned) installed on an upper surface of the cavity assembly 20.

A front plate 30 defining a front face of the cavity assembly 20 is provided with a door 32 for selectively opening and closing the cooking chamber 22. The door 32 selectively opens and closes the open front face of the cavity assembly 20. A control panel 34 through which the microwave oven is operated is provided on an upper portion of the front plate 30.

A rear plate 36 defining a rear face of the cavity assembly 20 is provided at a rear surface of the cavity assembly 20. The rear plate 36 and the front plate 30 protrude beyond an upper surface of the cavity assembly 20, so that a portion of the electric equipment installation chamber 24 is defined therebetween.

The outer case 38 defines external upper and side surfaces of the microwave oven. The outer case 38 is mounted on the cavity assembly 20 and serves to isolate the interior of the microwave oven including the electric equipment installation chamber 24 from the outside.

In the present embodiment, the outer case 38 comprises a first external face plate 40 and second external face plates 41. The first external face plate 40 defines an external appearance of the upper surface of the microwave oven, and the second external face plates 41 define external appearances of the side surfaces thereof. Thus, the outer case 38 of the present embodiment is provided with the second external face plates 41 vertically bent from both ends of the first external face plate 40. However, the outer case 38 may be variously configured. For example, the outer case 38 may comprise only the first external face plate 40.

The first external face plate 40 is shaped in a rectangular plate. As shown in FIG. 3, the opening 42 that is formed to have the shape of a rectangle is formed at a side of the first external face plate 40. The opening 42 is formed at a position corresponding to the right side of the electric equipment installation chamber 24, i.e., corresponding to a position where major parts are installed. It is preferred that the opening 42 be formed to have a half or less of the area of the first external face plate 40 so that the outer case 38 is formed to have certain strength against falling impacts.

As well shown in FIG. 3, semicircle-shaped fastening portions 44 which extend toward the center of the opening 42 are provided at a side of an edge of the opening 42. The fastening portions 44 to which a cover plate 52 that will be described below is fastened with screws are formed with circle-shaped fastening holes 44*a*, respectively. The fastening portions 44 are formed at positions spaced apart by different distances from both ends of the edge of the opening 42, respectively, i.e., asymmetrically at a side of the edge of the opening 42. This is to guide an assembling direction of the cover plate 52 that will be described below. Although the number of the fastening portions 44 is two in the present embodiment, it is not necessarily limited thereto.

Concave portions 46 are formed at a side opposite to the side of the edge of the opening 42 on which the fastening portions 44 are provided. The concave portions 46 are formed by removing portions of the first external face plate 40 corresponding to the side of the edge of the opening 42. Although the concave portions 46 are formed in a rectangular shape and at three positions in the present embodiment, they are not necessarily limited thereto.

Circular tool-passing holes 48 are formed at positions in the first external face plate 40 spaced apart by a certain distance from the concave portions 46. The screws 28*a* for fixing the high voltage transformer 28 are positioned vertically below the tool-passing holes 48. The tool-passing holes 48 are portions through which a tool for tightening and loosening the screws 28*a* is inserted.

A bead 50 formed in a concave-convex shape is provided in the other portion of the first external face plate 40 except the opening 42. The bead 50 serves to increase the strength of the first external face plate 40. The bead 50 is formed to protrude from the outer surface of the first external face plate 40 and to be depressed from the inner surface thereof, or to be depressed from the outer surface of the first external face plate 40 and to protrude from the inner surface thereof.

The opening 42 is covered with the cover plate 52. As well shown in FIG. 4, a body portion 54 of the cover plate 52 has an external appearance corresponding to the shape of the opening 42. That is, the body portion 54 is formed in a substantially rectangular shape.

The cover plate 52 is provided with a reinforcement portion 56, which serves to increase the strength of the cover plate 52. The reinforcement portion 56 is formed in a concave-convex shape to be depressed or protrude from the cover plate 52.

A marginal portion 58 is provided at an edge of the cover plate 52 corresponding to the edge of the opening 42. The marginal portion 58 is seated on a portion of the first external face plate 40 corresponding to the edge of the opening 42. The marginal portion 58 is stepwise formed in the body portion 54. The marginal portion 58 stepwise formed reinforces the cover plate 52.

Semicircular portions 60 are formed at a side of the marginal portion 58, i.e., at portions corresponding to the positions where the fastening portions 44 are formed. The semicircular portions 60 are provided with fastening holes 60*a* having the same shape as the fastening holes 44*a*, respectively. Moreover, extension portions 62 extending from the marginal portion 58 to the outside are provided at the other side of the marginal portion 58, i.e., at portions thereof corresponding to the positions where the concave portions 46 are formed. The semicircular portions 60 are formed at the positions corresponding to the fastening portions 44, and thus, provided at asymmetry positions along the side of the edge of the body portion 54. Since the semicircular portions 60 have a kind of concavo-convex shape, they also perform the reinforcement function.

The extension portions 62 are respectively formed in a rectangular shape. Although the number of the extension portions 62 is three in the present embodiment, it is not necessarily limited thereto. Two long ones of the extension portions 62 serve to cover the tool-passing holes 48. The remaining short extension portion 62 serves to prevent the side of the cover plate 52 from coming off the first external face plate 40 in a state where the cover plate 52 is seated on the first external face plate 40. Here, bent reinforcement portions 64 are provided to be slightly inclined at the distal ends of the long ones of the extension portions 62, respectively. The bent reinforcement portions 64 serve to strengthen the extension portions 62.

The extension portions 62 are positioned below the first external face plate 40. To this end, it is preferred that portions of the edge of the opening 42 corresponding to the concave portions 46 in which the extension portions 62 are positioned be formed so that the extension portions 62 can pass therethrough without interference.

Hereinafter, the operation of the outer case for a cooking appliance according to the present invention thus configured will be described in detail.

First, the schematic configuration of the microwave oven in which the present invention is employed will be explained. The door 32 installed on the front face of the cavity assembly 20 opens and closes the cooking chamber 22, and the outer case 38 defines the external appearance of the upper and side surfaces of the microwave oven. The opening formed in the first external face plate 40 of the outer case 38 is covered with the cover plate 52.

If in such a state, a part installed in the electric equipment installation chamber 24 is out of order during use of the microwave oven, the part is replaced or repaired through the opening 42 after separating the cover plate 52 from the outer case 38.

The marginal portion 58 of the cover plate 52 is seated on the portion of the first external face plate 40 corresponding to the edge of the opening 42. At this time, the extension portions 62 of the cover plate 52 are positioned below the first external face plate 40 and cover the tool-passing holes 48. The tool-passing holes 48 are covered accordingly, so that foreign materials and the like are prevented from being introduced through the tool-passing holes 48 from the outside.

In addition, the extension portions 62 are positioned below the first external face plate 40 through the concave portions 46 and the screws penetrating the fastening holes 60*a* of the semicircular portions 60 are fastened to the fastening holes 44*a* of the fastening portions 44, whereby the cover plate 52 is fixed to the first external face plate 40.

In such a state, when it is necessary to maintain and repair a part installed in the electric equipment installation chamber 24 during use of the microwave oven with the cover plate 52 covering the opening 42 of the first external face plate 40, the cover plate 52 is separated from the first external face plate 40.

That is, after loosening the screws fastened to the fastening holes 44*a* and 60*a* of the fastening portions 44 and the semicircular portions 60, the cover plate 52 is separated from the first external face plate 40 by allowing the extension portions 62 to come off the concave portions 46. Thus, as shown in FIG. 3, the opening 42 is in an open state. In a state where the opening 42 is open, the parts such as the magnetron 26 and the high voltage transformer 28 can be maintained and repaired through the opening 42.

Particularly, by inserting a tool through the tool-passing holes 48, it is possible to separate the screws 28*a* that fasten a part, for example, the high voltage transformer 28. The tool-passing holes 48 are formed in the portions of the first external face plate 40 corresponding to the peripheral portion of the opening 42, so that it is possible to relatively reduce the size of the opening 42. That is, this is because the opening 42 should be formed even beyond the positions where the tool-passing holes 48 are formed unless the tool-passing holes 48 are formed otherwise.

If the size of the opening 42 becomes relatively smaller, an area which the opening 42 occupies in the first external face plate 40 is relatively reduced. If the area which the opening 42 occupies in the first external face plate 40 is relatively reduced, the strength of the first external face plate 40 is relatively increased.

In addition, the bead 50 is formed in the region of the first external face plate 40 except the opening 42, so that the first external face plate 40 is relatively reinforced. The bead 50 is formed to protrude or be depressed from the first external face plate 40, thereby reinforcing the first external face plate 40 of a metal plate.

Meanwhile, after completing the maintenance work in a state where the cover plate 52 is removed, the extension portions 62 of the cover plate 52 are again pushed below the first external face plate 40 through the concave portions 46. Then, the semicircular portions 60 of the cover plate 52 and the fastening portions 44 of the opening 42 are fastened with screws, so that the cover plate 52 is fixed to the first external face plate 40.

At this time, the extension portions 62 extending from the cover plate 52 cover the tool-passing holes 48, whereby foreign materials or moisture can be prevented from being introduced into the microwave oven.

The scope of the present invention is not limited to the aforementioned embodiment but defined by the appended claims. It will be apparent that those skilled in the art can make various modifications and changes thereto within the scope of the invention defined by the claims.

For example, although the extension portions 62 of the cover plate 52 are configured so that they are inserted below the first external face plate 40 and thus cover the tool-passing holes 48 in the embodiment of the present invention, they are not necessarily limited thereto. That is, the extension portions 62 may also be positioned over the first external face plate 40, thereby covering the tool-passing holes 48.

In addition, although the first external face plate 40 and the second external face plates 41 are integrally formed with each other in the embodiment of the present invention, it is also possible to separately form the first external face plate 40 and the second external face plates 41 from each other and to assemble them.

Further, in order to quickly maintain and repair inner parts which are provided in the electric equipment installation chamber 24 and located at positions corresponding to the second external face plates 41, the second external face plate 41 may be formed with an additional opening, which may be selectively covered with a cover plate.

Although the embodiment of the present invention has been described by way of example in connection with a microwave oven, it will be apparent that another cooking appliance provided with an outer case covering a space in which inner parts are installed may also be applied to the present invention.

INDUSTRIAL APPLICABILITY

An outer case for a cooking appliance according to the present invention specifically described above causes inner parts to be maintained and repaired through an opening formed in the outer case. Thus, there are advantages in that the maintenance and repair work of a cooking appliance can be quickly performed and a user is prevented from misunderstanding a trouble of inner parts as a severe failure.

Further, in the present invention, a tool-passing hole is formed near the opening in order to minimize the size of the opening formed in the outer case. Thus, there are also advantages in that it is possible to relatively increase the strength of an external face plate of the outer case in which the opening is formed and a tool can be inserted at the exact location of a screw to rotate the screw.

Also, in the present invention, a bead is formed in an area except the opening of the external face plate in which the opening is formed, so that the external face plate is reinforced. Thus, there are advantages in that the opening is formed in the outer case thereby easily maintaining and repairing inner parts and the strength of the outer case can be maintained at a certain level or more, thereby relatively increasing durability against external impacts.

Further, in the present invention, a reinforcement portion, a marginal portion and semicircular portions are also provided in a cover plate for covering the opening of the external face plate, thereby maximally increasing the strength of the cover plate. Therefore, such a cover plate is mounted on the external face plate, so that the entire strength of the external face plate mounted with the cover plate can be maintained at a certain level or more.

Also, the positions where semicircular portions and fastening portions are formed for fastening the cover plate and the external face plate are not symmetric at corresponding sides of edges of the cover plate and the opening, respectively, so that the mounting direction of the cover plate is guided when the cover plate is mounted on the opening of the external face plate. Thus, there is an advantage in that the work of mounting the cover plate is more quickly obtained.

The invention claimed is:

1. An outer case for a cooking appliance having a cooking chamber and an electrical device chamber formed therein, the outer case comprising:

a first external face plate having an opening formed therein at a position corresponding to at least one electrical device installed in the electrical device chamber, the first external face plate defining a portion of an external surface of the cooking appliance;

a cover plate removably coupled to the first external face plate so as to selectively cover the opening formed in the first external face plate, the cover plate including at least one extension that engages a corresponding edge portion of the opening and at least one cover fastening hole formed therein corresponding to at least one plate fastening hole formed in the cover plate so as to selectively fasten the cover plate to the first external face plate; and at least one tool-passing hole formed through the first external face plate near the opening, wherein the at least one tool-passing hole is configured to receive a tool therethrough for tightening and loosening a fastener that secures the at least one electrical device in the electrical device chamber, wherein the at least one extension extends across the at least one tool-passing hole when the cover plate is fastened to the first external face plate, wherein the cover plate comprises:

a body portion having a shape corresponding to the opening; and a marginal portion that extends around an edge of the body portion and formed as a step so as to be seated on an edge of the opening, wherein the at least one extension extends outward from a side of the body portion, and wherein the at least one extension covers the at least one tool-passing hole.

2. The outer case as claimed in claim 1, wherein the at least one extension is inserted into a corresponding cutaway portion formed in the first external face plate, and the at least one cover fastening hole is formed in a semicircular portion having an asymmetric concave-convex shape along a side of the marginal portion, with a fastener extending through the at least one cover fastening hole and at least one plate fastening hole so as to couple the cover plate to the first external face plate.

3. The outer case as claimed in claim 1, further comprising a pair of second external face plates provided at opposite ends of the first external face plate and extending perpendicular thereto.

4. The outer case as claimed in claim 3, wherein an area of the opening is less than a half of an entire area of the first external face plate, and wherein a bead is formed in a portion of the first external face plate outside of the opening.

5. The outer case as claimed in claim 4, wherein the body portion of the cover plate further comprises a reinforcement portion.

6. The outer case as claimed in claim 5, wherein the cooking appliance comprises a microwave oven, and wherein the first external face plate extends across the electric device chamber, the electric device chamber being positioned above the cooking chamber.

7. The outer case as claimed in claim 1, wherein the at least one extension comprises a plurality of extensions that each extend outward from one side of the cover plate.

8. The outer case as claimed in claim 7, further comprising a plurality of cutaway portions formed in an edge portion of the opening corresponding to the plurality of extensions, wherein the plurality of cutaway portions are configured to receive the plurality of extensions therein when the cover plate is coupled to the first external face plate.

9. The outer case as claimed in claim 8, wherein the at least one tool-passing hole is formed in the first external face plate near an end of one of the plurality of cutaway portions such that the at least one tool-passing hole is covered by a corresponding extension inserted in the cutaway portion when the cover plate is coupled to the first external face plate.

* * * * *